US006632061B2

(12) United States Patent
Trovinger

(10) Patent No.: US 6,632,061 B2
(45) **Date of Patent: *Oct. 14, 2003**

(54) BOOKLET MAKER WITH SHEET WISE TRIM

(75) Inventor: Steven W Trovinger, Los Altos, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/820,739

(22) Filed: Mar. 30, 2001

(65) Prior Publication Data

US 2002/0146302 A1 Oct. 10, 2002

(51) Int. Cl.[7] ..... B42C 13/00

(52) U.S. Cl. ..... 412/11; 83/869; 271/3.01; 271/3.13; 271/8.1; 271/10.01; 412/1; 412/9; 412/16

(58) Field of Search ..... 412/1, 3, 9, 11, 412/13, 16, 17, 18, 19, 21, 32; 271/3.01, 3.02, 3.08, 3.13, 3.14, 3.15, 8.1, 10.01; 83/869

(56) References Cited

U.S. PATENT DOCUMENTS

| | | | | |
|---|---|---|---|---|
| 4,053,150 | A | | 10/1977 | Lane |
| 4,221,373 | A | | 9/1980 | Muller Hans |
| 4,484,501 | A | | 11/1984 | Ramcke |
| 4,575,296 | A | | 3/1986 | Kockler et al. |
| 4,595,187 | A | | 6/1986 | Bober |
| 4,795,071 | A | | 1/1989 | Jacobs et al. |
| 4,891,681 | A | | 1/1990 | Fiske et al. |
| 5,028,193 | A | | 7/1991 | Misicka |
| 5,087,163 | A | | 2/1992 | Erdbories et al. |
| 5,346,350 | A | | 9/1994 | Luhman et al. |
| 5,377,965 | A | | 1/1995 | Mandel et al. |
| 5,452,920 | A | | 9/1995 | Parker |
| 5,465,213 | A | | 11/1995 | Ross |
| 5,632,587 | A | | 5/1997 | Coyette |
| 5,662,318 | A | | 9/1997 | Harada et al. |
| 5,803,891 | A | | 9/1998 | Haan et al. |
| 5,882,004 | A | | 3/1999 | Padget |
| 5,988,628 | A | * | 11/1999 | Mori ..... 271/117 |
| 6,099,225 | A | * | 8/2000 | Allen et al. ..... 412/1 |
| 6,193,458 | B1 | | 2/2001 | Marsh |
| 6,315,282 | B2 | * | 11/2001 | Chua et al. ..... 271/121 |
| 6,363,851 | B1 | | 4/2002 | Gerhard et al. |
| 2001/0048863 | A1 | * | 12/2001 | Bagrosky ..... 412/25 |

FOREIGN PATENT DOCUMENTS

| | | |
|---|---|---|
| EP | 0992365 A1 | 4/2000 |
| WO | WO 0018583 | 4/2000 |

OTHER PUBLICATIONS

Berger P: "Investieren Mit Blick Auf Digitale Nischenprodukte" Deutscher Drucker, Deutscher Drucker Verlagsgesellschaft, Ostfildern, DE, vol. 34 No. 35. Septeber 17, 1998 (Sep. 17, 1998) p. W45, W48 XP000783487. Relevant claims: 1, 4.

* cited by examiner

*Primary Examiner*—Monica Carter

(57) ABSTRACT

A trimming apparatus for a booklet maker is described which provides a compact and low cost booklet maker for desktop publishing. The booklet maker includes a sheet receiving tray for receiving a stack of sheets to be stapled into a booklet, a stapler unit arranged to staple the stack of sheets, and a trimming system for trimming the sheets in a sheet wise manner. The trimming system includes first and second pick and separate mechanisms arranged to separate each of the sheets in the stack of sheets and first and second cutters arranged to cut each of the separated sheets after the have been separated by the first and second pick and separate mechanisms. A controller positions the sheets and controls the trimming system to cut each of the separated sheets at a location determined based on a trimming schedule. The trimming schedule varies the position of the cut depending on a position of the sheet in the booklet and a thickness of the sheets.

18 Claims, 4 Drawing Sheets

BOOKLET MAKER WITH SHEET WISE TRIM

BACKGROUND OF THE INVENTION

1. Field of the Invention

The invention relates to a booklet maker and a trimming system for a booklet maker, and more particularly, the invention relates to a sheet wise trimming system for a booklet maker which trims the sheets of a booklet to a desired size.

2. Brief Description of the Related Art

Automated saddle stitch booklet makers are currently used to bind many sheets of duplex printed material into a finished booklet. The currently known booklet making machines perform operations such as stapling, folding and trimming of sheets. Generally these booklet making machines perform these functions on many sheets at a time requiring high forces, powerful motors, and dangerous cutting devices. Such booklet making machines are expensive, often exceeding the cost of desktop or office printers. As such, known booklet making machines are not well suited for use in low cost desktop booklet making.

Accordingly, there is a need for electronic desktop publishing machines for forming booklets which are compact, low cost, high quality and suitable for use with desktop laser and ink jet printers.

In conventional booklet making machines the booklets are first assembled, stapled, and folded and then the edges of the sheets are trimmed together to achieve a finished and flush edge to the sheets. Trimming is necessary to produce a finished booklet with pages which are flush and easy to flip through. A trimmed booklet also has a more attractive appearance. However, as discussed above, the trimming of the sheets of an entire booklet at one time requires high forces and powerful motors. These powerful motors are expensive and large increasing the cost and size of a booklet maker.

U.S. Pat. No. 6,099,225 describes a booklet maker and a booklet making process in which sheets are trimmed by an individual sheet trimming operation to reduce the force needed for trimming. According to this booklet making process, the sheets are trimmed to length first and, then folded, assembled, and stapled. The trimming of individual sheets allows the use of smaller and less expensive trimming systems. However, this process has the drawback that the trimmed and folded sheets must be assembled into the booklet which may be more difficult than assembling sheets before trimming and folding.

Accordingly, it would be desirable to provide a booklet maker which can perform trimming of individual sheets after assembly of the sheets into a booklet to eliminate a need to handle folded sheets.

SUMMARY OF THE INVENTION

The present invention relates to a booklet maker, a trimming system for a booklet maker, and a method of making booklets in which stacked sheets are individually trimmed to create a final finished edge of a booklet.

In accordance with one aspect of the present invention, a booklet maker includes a sheet receiving tray for receiving a stack of sheets to be stapled into a booklet, a stapler unit arranged to staple the stack of sheets, a first pick and separate mechanism arranged to separate each the sheets in the stack of sheets, a first cutter arranged to cut each of the separated sheets after the sheets have been separated by the first pick and separate mechanism, and a controller for positioning the sheets and controlling the first cutter to cut each of the separated sheets at a location determined based on a position of the sheet in the booklet.

In accordance with an additional aspect of the present invention, a trimming system for a booklet maker includes a first pick and separate mechanism arranged to separate each sheet in a stack of sheets forming a booklet, a first cutter arranged to cut each of the separated sheets after the sheets have been separated by the first pick and separate mechanism, and a controller for controlling the first cutter to cut each of the separated sheets at a location determined based on sheet information.

In accordance with a further aspect of the invention, a method of forming a booklet includes the steps of stacking a plurality of printed sheets; stapling the printed sheets along a centerline to form a booklet; and trimming the edges of the sheets in the stapled booklet on a sheet by sheet basis according to a trimming schedule.

The present invention provides advantages of a more compact and less expensive stapling apparatus for use in a desktop booklet making apparatus.

BRIEF DESCRIPTION OF THE DRAWINGS

The invention will now be described in greater detail with reference to the preferred embodiments illustrated in the accompanying drawings, in which like elements bear like reference numerals, and wherein.

DETAILED DESCRIPTION OF THE PREFERRED EMBODIMENTS

Figure 1A:
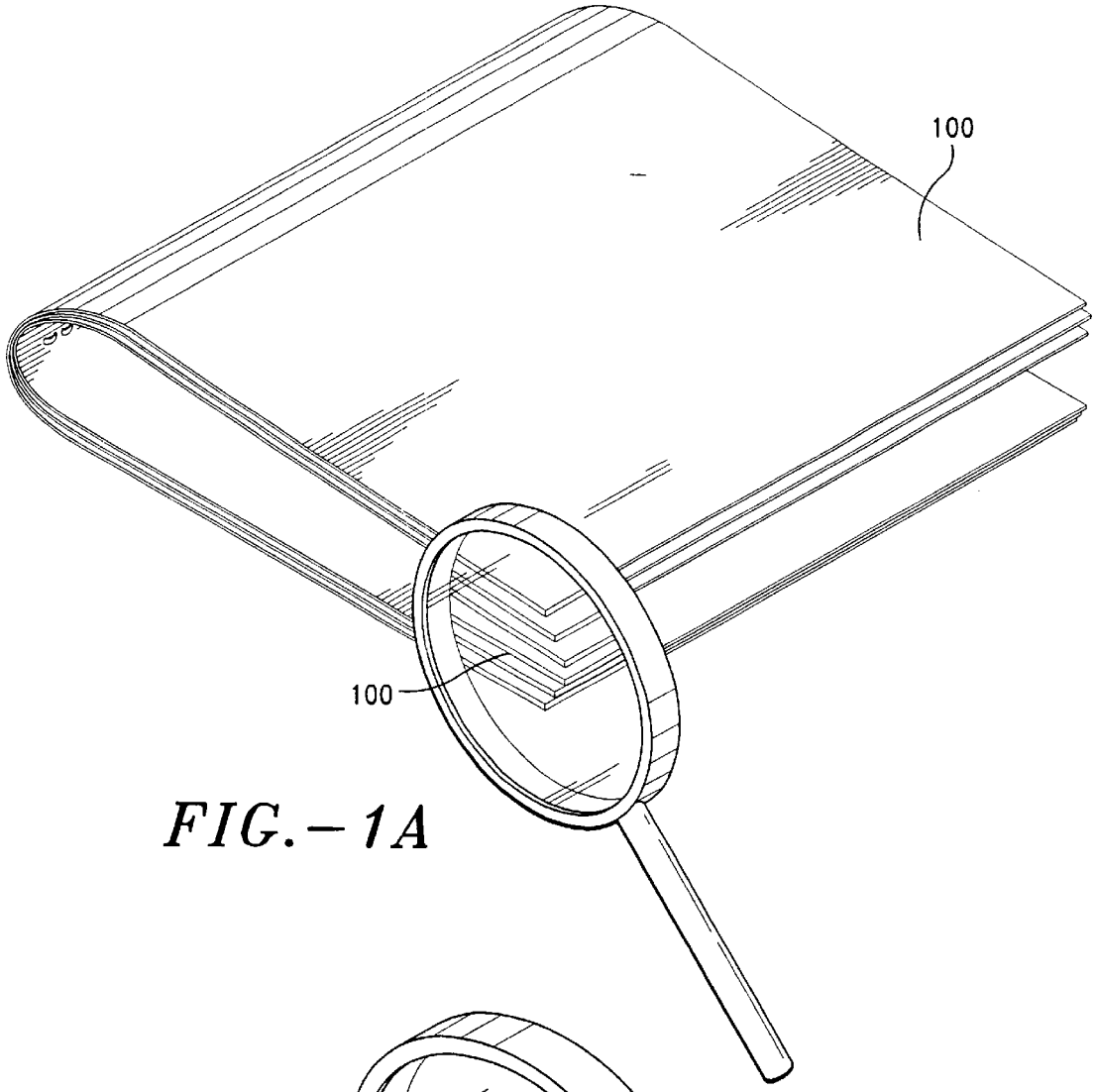
FIG. 1A is a perspective view of a saddle stitched booklet with an enlarged portion showing untrimmed edges.
Figure 1B:
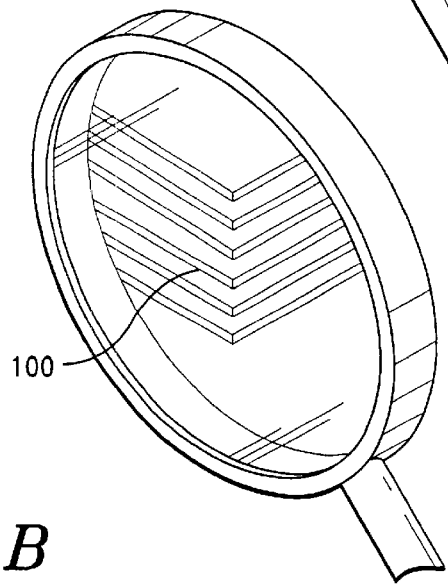
FIG. 1B is an enlarged portion of the saddle stitched booklet of FIG. 1 with trimmed edges.

FIGS. 1A and 1B illustrate the difference between a booklet 100 with untrimmed sheets (FIG. 1A) and a booklet with trimmed sheets (FIG. 1B). The present invention provides a system and method for trimming the sheets of a booklet to form a flush edge, as shown in FIG. 1B, by a sheet wise trimming operation which will be described in detail below. The trimming system according to the present invention processes an assembled booklet 100 in a sheet wise trimming operation which trims individual sheets depending on a paper thickness and a position of the sheet in the booklet.

In a typical finishing process, sheets of equal dimension are assembled in a stack, the stack is then stapled, folded, and finally trimmed to produce an even edge. Because outer sheets wrap around inner sheets, simply assembling the booklet and stapling produces a chaffered edge (FIG. 1A) with the inner sheets sticking out and the outer sheets and cover appearing to be shorter. Traditionally, the entire booklet is trimmed inboard of the edge of the cover or at the edge of the shortest sheet with the longest wrap length to produce an even edge (FIG. 1B).

Figure 2:
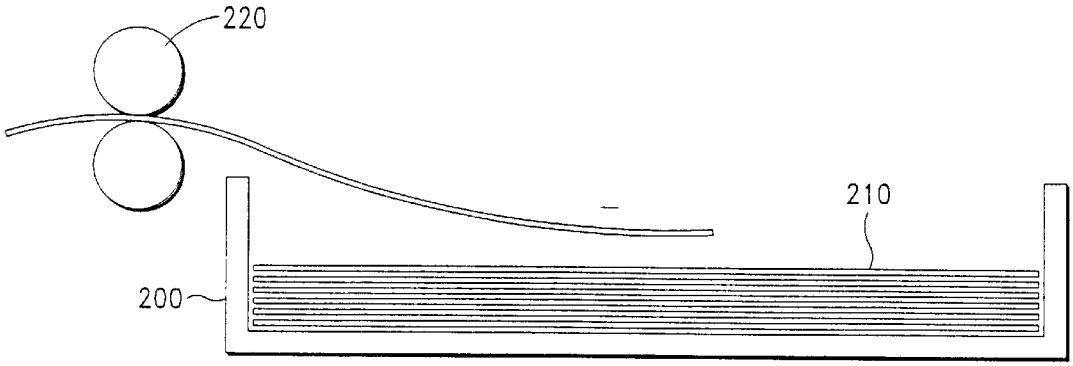
FIG. 2 is a schematic side view of a sheet collection tray of a booklet maker according to the present invention.

The system and method for trimming sheets in a booklet maker will now be described with reference to FIGS. 2–7 showing the steps of performing the trimming operation. FIG. 2 illustrates a print a collect stage in which printed booklet pages 210 are delivered to a collection tray 200. A pair of sheet transport rollers 220 deliver the printed sheets 210 to the collection tray 200 in a known manner. The collection tray 200 jogs each sheet in two directions to insure that the stack of sheets is squared up. The collection tray 200 may perform the jogging operation after each sheet 210 is delivered to the collection tray, after a plurality of sheets are delivered to the tray, or after all of the sheets have been placed in the tray.

Figure 3:
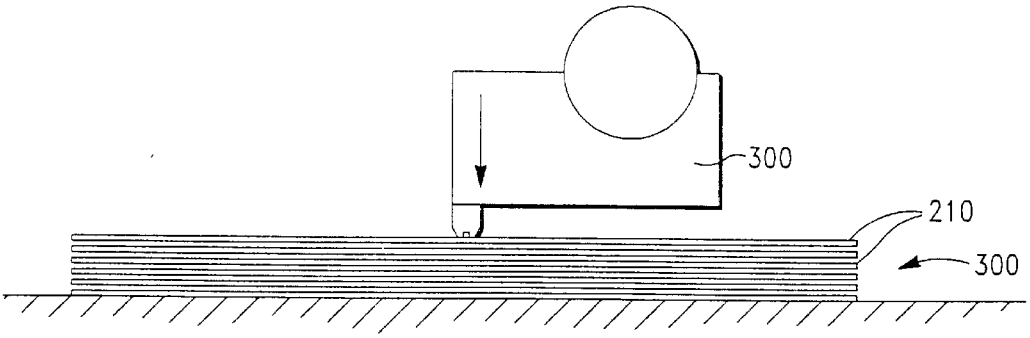
FIG. 3 is a schematic side view of a stapler unit of the booklet maker according to the present invention.

After collection of the sheets 210 in the collection tray 200, the sheets are stapled by a stapler unit 300 as shown in FIG. 3. The stack of sheets 310 is moved from the collection tray 200 to the stapler unit 300 in a known manner. The stack 310 is positioned such that the center of the sheets 210 is positioned under the stapler unit 300. The stapler unit 300 may include a single movable stapler or multiple fixed staplers. The staplers may employ any of the known passive or active clinch mechanisms. Alternatively, the stapler unit 300 may be positioned to staple the sheets 210 while the sheets are still located in the collection tray 200. Once the sheets 210 are positioned under the stapler unit 300 and are jogged and square, the sheets are stapled into a booklet.

Figure 4:
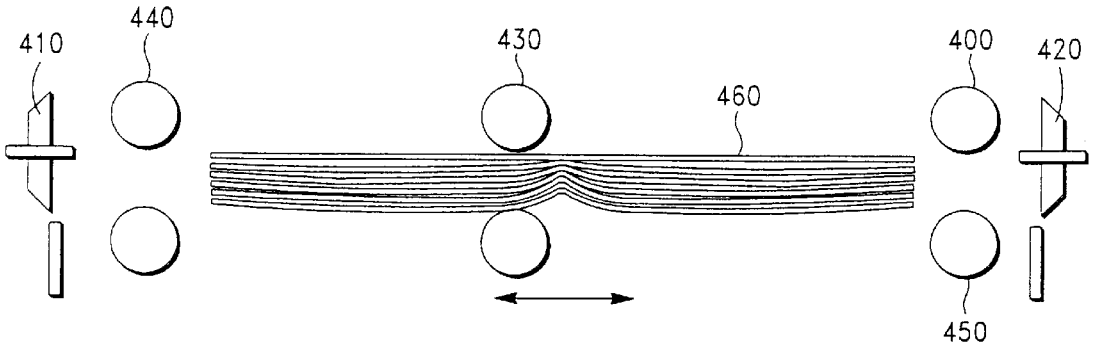
FIG. 4 is a schematic side view of a trimming unit of the booklet maker according to the present invention.

FIGS. 4–7 illustrate the operations of separating and trimming the stapled sheets. FIG. 4 shows a trimming unit 400 of the booklet maker according to the present invention. The trimming unit 400 includes a first cutter 410, a second cutter 420, a pair of booklet advancing rollers 430, a first pick and separate mechanism 440, and a second pick and separate mechanism 450. The assembled and stapled booklet 460 is moved side to side by the booklet advancing rollers 430 as follows.

Figure 5:
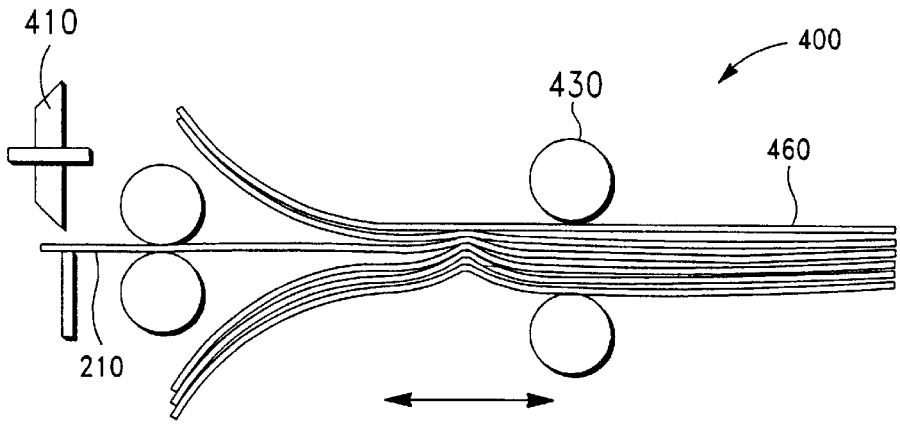
FIG. 5 is a schematic side view of the trimming unit of FIG. 4 showing operation of a pick and separate mechanism of the present invention.

FIG. 5 shows the trimming unit 400 with the booklet 460 moved to the left for the separation of a sheet 210 with the pick and separate mechanism 440. The pick and separate mechanism 440 is a typical pick and separate mechanism such as those used in printers.

Figure 6:
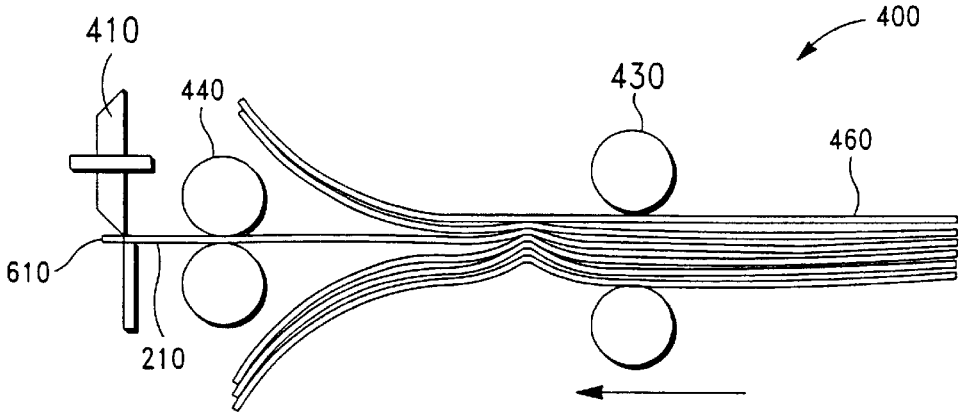
FIG. 6 is a schematic side view of the trimming unit of FIG. 4 showing operation of a first cutter of the present invention.

Once a single sheet 210 has been separated as shown in FIG. 5, the sheet is advance to the first cutter 410 which trims the sheet at a desired location, as shown in FIG. 6. Trimming is performed with a low cost, low force cutter 410 which easily trims the sheets in a sheet wise manner. A trimmed portion of the sheet 610 is discarded to a waste bin (not shown).

Figure 7:
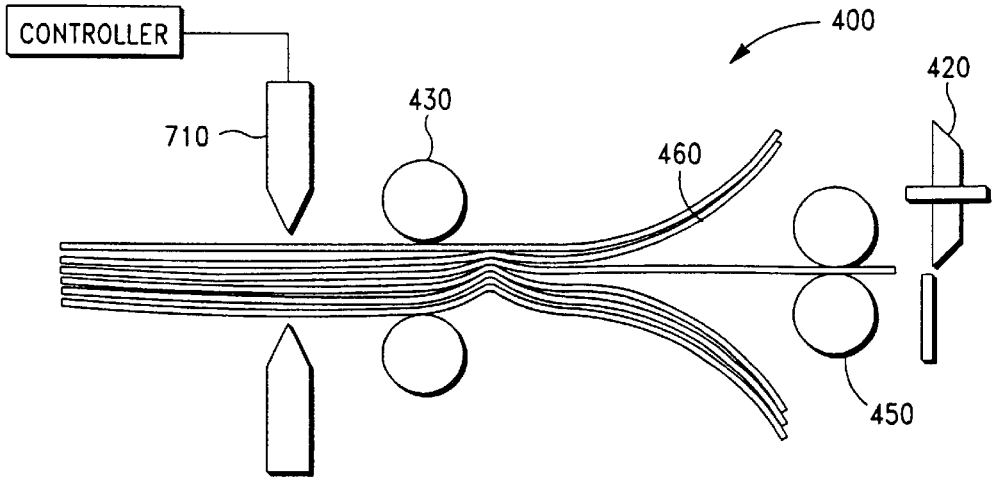
FIG. 7 is schematic side view of the trimming unit of FIG. 4, showing operation of a second pick and separate mechanism of the present invention.

As shown in FIG. 7, the booklet 460 is then shifted to the right by the booklet advancing rollers 430 and the second pick and separate mechanism 450 separates a sheet to be trimmed by the second cutter 420. This process of alternating pick, separate, move, and trim is repeated until each of the sheets have been trimmed to a length which is determined by a trim schedule.

According to one preferred embodiment of the invention, after all the sheets have been trimmed on both sides of the booklet, the booklet is folded along the centerline to form a finished booklet. In an alternative embodiment, the sheets may be folded prior to trimming.

Precision positioning for trimming of each sheet is achieved by a precision drive system which is similar to those used in a deskjet printer. When the trimming operation is complete, each sheet has been trimmed to a unique and precise length so that the edge of the assembled booklet is flat, as shown in FIG. 1B, as if all the sheets had been trimmed together in a final trimming operation. The sheet width is determined by an algorithm and is a function of the page number and the thickness of the paper. U.S. Pat. No. 6,099,225 describes an example of a trim schedule for a trim operation which trims each sheet prior to folding and assembling. This trim schedule can be modified for use in the present invention by trimming half the total trim amount from each side of the sheet.

The trimming unit 400 is controlled by a controller 700 to trim each sheet to a proper length. According to one embodiment, the controller 700 employs a paper edge sensor 710, shown in FIG. 7, such as an optoelectronic sensor to sense an edge of a paper sheet. The paper sheet is moved precisely with respect to the sensed position of the paper edge to make a cut in accordance with the trim schedule.

Although the invention has been described as employing a folding mechanism after the stapling and trimming operations, it should be understood that the order of these steps may be varied.

Figure 8:
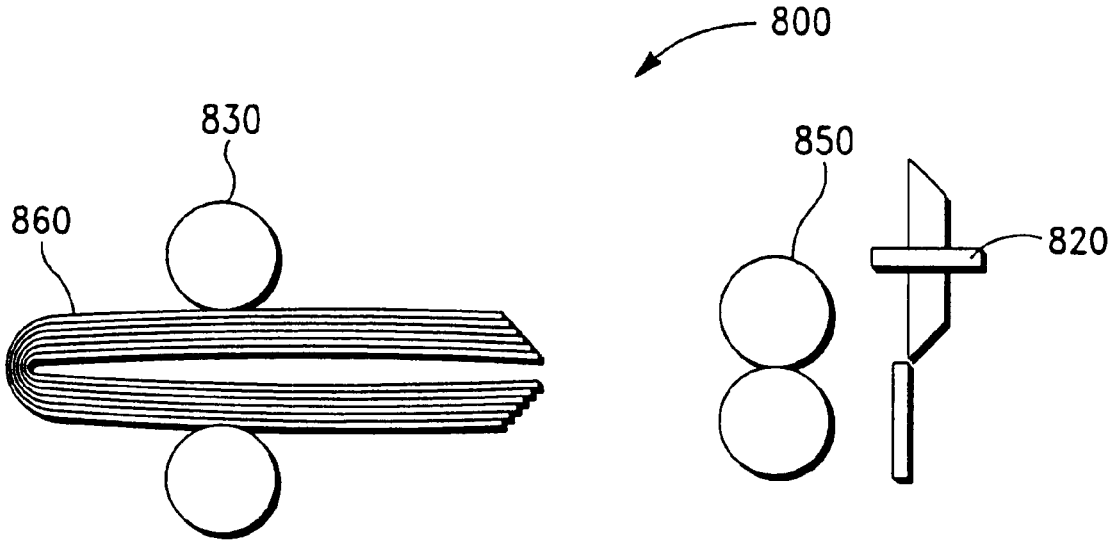
FIG. 8 is a schematic side view of an alternative embodiment of a trimming unit according to the present invention.

For example, FIG. 8 illustrates an alternative embodiment in which the sheets are stapled and folded prior to trimming. FIG. 8 illustrates a trimming unit 800 having a first cutter 820, a pair of booklet advancing rollers 830, and a pick and separate mechanism 850. The trimming unit 800 operates in the manner described above with respect to the previous embodiment but performs trimming on sheets 860 of a stapled and folded booklet.

The systems used to load, align, register, and staple sheets in the booklet maker according to the present invention are those that are known to those in the field of desktop and commercial printers.

The operation of a desktop booklet maker including the stacking, folding, stapling, and other operations is described in further detail in U.S. Pat. No. 6,099,225 and International Publication No. WO 00/18583 both of which are incorporated herein by reference in their entirety.

While the invention has been described in detail with reference to the preferred embodiments thereof, it will be apparent to one skilled in the art that various changes and modifications can be made and equivalents employed, without departing from the present invention.

What is claimed is:

1. A booklet maker comprising:

a sheet receiving tray for receiving a stack of sheets to be stapled into a booklet;

a stapler unit arranged to staple the stack of sheets;

a first pick and separate mechanism arranged to separate a portion of each of the stapled sheets in the stack of sheets;

a first cutter arranged to cut each of the separated sheets after the sheets have been separated by the first pick and separate mechanism; and a controller for positioning the sheets and controlling the first cutter to cut each of the separated sheets at a location determined based on a position of the sheet in the booklet.

2. The booklet maker of claim 1, wherein the controller positions the sheets and controls the cutter to cut each of the separated sheets at a location determined based on both a position of the sheet in the booklet and sheet thickness.

3. The booklet maker of claim 1, further comprising a sensor for sensing a location of the sheets.

4. The booklet maker of claim 1, further comprising a second pick and separate mechanism and a second cutter.

5. The booklet maker of claim 4, wherein the first pick and separate mechanism and the first cutter are arranged to separate and cut a first side of the booklet and the second pick and separate mechanism and the second cutter are arranged to separate and cut a second side of the booklet opposite the first side.

6. The booklet maker of claim 1, wherein the stapler unit is arranged to staple the stack of sheets prior to cutting.

7. A trimming system for a booklet maker, the trimming system comprising:

a first pick and separate mechanism arranged to separate each sheet in a stack of sheets forming a booklet;

a first cutter arranged to cut each of the separated sheets after the sheets have been separated by the first pick and separate mechanism; and a controller for controlling the first cutter to cut each of the separated sheets at a location determined based on sheet information.

8. The trimming system of claim 7, wherein the sheet information includes information about a location of the sheet in the booklet.

9. The trimming system of claim 8, wherein the sheet information includes information about a thickness of the sheets in the booklet.

10. The trimming system of claim 7, further comprising a sensor for sensing a location of the sheets.

11. The trimming system of claim 7, further comprising a second pick and separate mechanism and a second cutter.

12. The trimming system of claim 11, wherein the first pick and separate mechanism and the first cutter are arranged to separate and cut a first side of the booklet and the second pick and separate mechanism and the second cutter are arranged to separate and cut a second side of the booklet opposite the first side.

13. A method of forming a booklet comprising:

stacking a plurality of sheets;

stapling the sheets along a centerline to form a booklet; and trimming the edges of the sheets in the stapled booklet on a sheet by sheet basis according to a trimming schedule.

14. The method of claim 13, wherein the trimming is performed by moving the stapled booklet back and forth while separating and trimming individual sheets on opposite sides of the booklet.

15. The method of claim 13, wherein the booklet is folded along the centerline after the step of trimming the edges of the sheets.

16. The method of claim 13, wherein the trimming is performed by two cutters arranged on opposite sides of the booklet.

17. The method of claim 13, further comprising sensing a position of the sheets in the booklet and precisely moving the booklet to a desired position for trimming each of the sheets in the stapled booklet.

18. The method of claim 13, wherein the booklet is folded along the centerline before the step of trimming the edges of the sheets.

* * * * *